US009874071B2

(12) United States Patent
Hern et al.

(10) Patent No.: US 9,874,071 B2
(45) Date of Patent: Jan. 23, 2018

(54) DISINTEGRATING PLUG FOR SUBTERRANEAN TREATMENT USE

(71) Applicant: BAKER HUGHES INCORPORATED, Houston, TX (US)

(72) Inventors: Gregory L. Hern, Porter, TX (US); Levi B. Oberg, Houston, TX (US); YingQing Xu, Tomball, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 15/242,251

(22) Filed: Aug. 19, 2016

(65) Prior Publication Data

US 2016/0356116 A1 Dec. 8, 2016

Related U.S. Application Data

(63) Continuation of application No. 14/284,611, filed on May 22, 2014, now Pat. No. 9,428,986.

(51) Int. Cl.

| | |
|---|---|
| ***E21B 33/129*** | (2006.01) |
| ***E21B 33/12*** | (2006.01) |
| ***E21B 23/01*** | (2006.01) |

(52) U.S. Cl.

CPC ..... *E21B 33/1292* (2013.01); *E21B 23/01* (2013.01); *E21B 33/12* (2013.01); *E21B 33/1208* (2013.01); *E21B 33/1291* (2013.01)

(58) Field of Classification Search

None

See application file for complete search history.

(56) References Cited

U.S. PATENT DOCUMENTS

| | | | |
|---|---|---|---|
| 2,196,661 | A | 4/1940 | Grubb |
| 3,506,067 | A | 4/1970 | Maurice |
| 3,530,934 | A | 9/1970 | James |
| 6,695,050 | B2 | 2/2004 | Winslow et al. |
| 6,793,022 | B2 | 9/2004 | Vick et al. |
| 7,210,533 | B2 | 5/2007 | Starr et al. |
| 7,424,909 | B2 | 9/2008 | Roberts et al. |
| 7,784,797 | B2 | 8/2010 | Baugh et al. |
| 8,899,317 | B2 | 12/2014 | Frazier |
| 8,950,504 | B2 | 2/2015 | Xu et al. |
| 2008/0308266 | A1 | 12/2008 | Roberts et al. |
| 2011/0259610 | A1 | 10/2011 | Shkurti et al. |
| 2012/0097384 | A1 | 4/2012 | Valencia et al. |
| 2012/0205091 | A1 | 8/2012 | Turley et al. |
| 2012/0292052 | A1 | 11/2012 | Xu et al. |
| 2013/0000914 | A1 | 1/2013 | Kelbie et al. |
| 2013/0240200 | A1 | 9/2013 | Frazier |
| 2013/0299192 | A1 | 11/2013 | Xu et al. |

(Continued)

*Primary Examiner* — Shane Bomar

(74) *Attorney, Agent, or Firm* — Steve Rosenblatt

(57) ABSTRACT

A disintegrating plug uses a setting tool to push a swage into the plug body that has external ribs that contact the wall of the surrounding tubular. The ribs retain the body to the surrounding tubular wall with frictional contact. Some leakage may ensue but in fracturing some leakage does not matter if enough volume under the right pressure reaches the formation. The sheared member during the setting comes out with the mandrel that is part of the setting tool. In an alternative embodiment one or more o-rings are used to seal while anchoring is assisted by the hardened insert(s) that can be snap fitted in using rib flexing or that can be a c-ring that is expanded and snapped in. The o-ring(s) are axially spaced from the insert(s).

24 Claims, 1 Drawing Sheet

(56) References Cited

U.S. PATENT DOCUMENTS

| | | | |
|---|---|---|---|
| 2014/0014339 | A1 | 1/2014 | O'Malley et al. |
| 2014/0027128 | A1 | 1/2014 | Johnson |
| 2014/0224506 | A1 | 8/2014 | Xu et al. |
| 2015/0285026 | A1 | 10/2015 | Frazier |

DISINTEGRATING PLUG FOR SUBTERRANEAN TREATMENT USE

RELATED APPLICATION DATA

This application is a continuation of application Ser. No. 14/284,611, filed on May 22, 2014, to issue as U.S. Pat. No. 9,428,986 on Aug. 30, 2016, and incorporated herein by reference in its entirety.

FIELD OF THE INVENTION

The field of the invention is barrier plugs for use in subterranean locations for formation treatment and more particularly plugs that substantially disintegrate when the treatment has ended.

BACKGROUND OF THE INVENTION

In certain types of treatments such as fracturing, a series of barriers with ball seats are used for the purpose of sequentially isolating intervals that have already been fractured so that the next interval uphole can be perforated and fractured. Typical of such plug devices is Us2013/0000914. Here sleeves are expanded that have an external seal and a lower end ball seat. At the end of the fracturing operation all the sleeves that were used have to be milled out.

US 2014/0014339 shows the use of a plug with an external rubber seal that is expanded with a swage moved by a wireline setting tool where the swage has a ball seat and is made of a disintegrating material. The design uses a shear device to the setting tool mandrel that remains behind as well as a rubber sleeve.

U.S. Pat. No. 7,784,797 shows the use of hardened insert segments with square bases that are dropped into an associated recess and then overlaid with rubber to retain the insert for running in. On setting, the hardened particles emerge through the rubber to aid in fixation of the expanded liner hanger. This being a liner hanger installation there is no need for any components to later disintegrate.

Several features are included in the present invention such as the use of degradable ribs without any seals for a fracturing application. While the ribs alone may not create a perfect seal on expansion and may not penetrate the surrounding tubular, a fracturing application can tolerate some leakage as long as the required flow can be delivered at the needed pressure to the formation. Additionally hardened materials, while having a benefit to enhance wall penetration into the surrounding tubular for enhanced grip are still limited in their degree of expansion and are not materials that are degradable. This can then leave residue when degrading other parts of a fracturing plug. The design of the shear tab from the fracturing plug is such that it extends into a mandrel of the setting tool that is removed from the plug when using a wireline setting tool such as the E-4 setting tool offered by Baker Hughes Incorporated of Houston, Tex.

An alternative design features the use of flexing ribs that do not necessarily penetrate the wall of the surrounding tubular but that can be made of a disintegrating material. These are combined with an o-ring seal to minimize the non-degrading parts when the plug is no longer needed and has to be removed to facilitate other completion steps or production. Hardened inserts are provided at a spaced location from the o-ring. The inserts can be in the shape of a c-ring and spread and snapped in or using flexing of an adjacent rib inserted as discrete units to be retained with a potential energy force from the adjacent flexed rib. While the hardened inserts and the o-rings do not disintegrate the bulk of the plug will disintegrate facilitating subsequent operations. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A disintegrating plug uses a setting tool to push a swage into the plug body that has external ribs that contact the wall of the surrounding tubular. The ribs retain the body to the surrounding tubular wall with frictional contact. Some leakage may ensue but in fracturing some leakage does not matter if enough volume under the right pressure reaches the formation. The sheared member during the setting comes out with the mandrel that is part of the setting tool. In an alternative embodiment one or more o-rings are used to seal while anchoring is assisted by the hardened insert(s) that can be snap fitted in using rib flexing or that can be a c-ring that is expanded and snapped in. The o-ring(s) are axially spaced from the insert(s).

DETAILED DESCRIPTION OF THE PREFERRED EMBODIMENT

Figure 1:
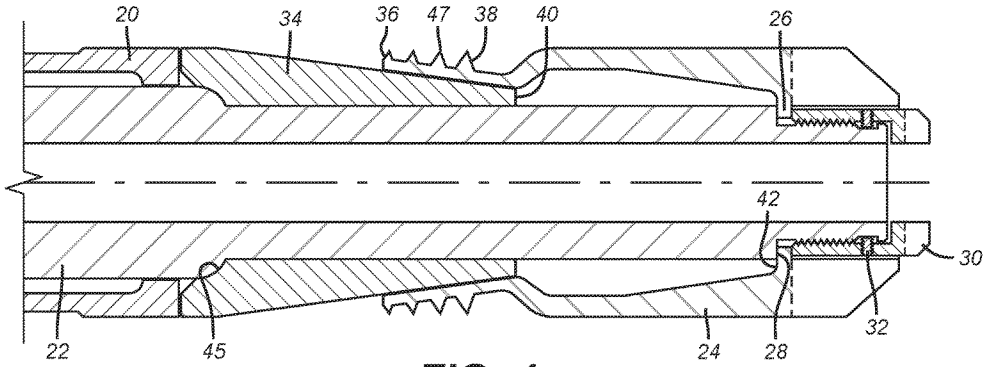
FIG. 1 is a half section view of an embodiment using disintegrating ribs that friction grip with no seal.

FIG. 1 shows a setting sleeve 20 and a mandrel 22 that are part of a wireline setting tool that is not shown. The mandrel 22 supports the plug 24 due to tab 26 being positioned on shoulder 28 and retained there by bushing 30 which is further retained by set screw 32. During the setting the wireline setting tool such as an E-4 made by Baker Hughes Incorporated of Houston, Tex. pushes down on sleeve 20 while pulling up on mandrel 22 so that the cone 34 ramps out the top end 36 of the plug 24. Near the top end 36 are a series of ribs 38 made preferably from a disintegrating material when exposed to certain well conditions or fluids. One such material is a controlled electrolytic material or CEM as described in US Publication 2011/0136707 and related applications filed the same day. The related applications are incorporated by reference herein as though fully set forth. As a result when the proper conditions are obtained the plug 24 will fully disintegrate as it constituent components such as the cone 34 and it body now missing tab 26 that was sheared off when the plug 24 was set and the mandrel 22 removed from the plug 24 are now all made from the disintegrating material. It should be noted that the lower end 40 of the cone 34 will come to a stop before or at travel stop 42. The use of the disintegrating material for the creation of the ribs allows the points 44 of the ribs 38 to move out radially into contact with the surrounding tubular that is not shown. In applications such as fracturing an absolute seal is not required as long as enough volume under the needed pressure gets delivered to the formation. While the points 44 do not necessarily penetrate the surrounding tubular and when made of a disintegrating material will most likely provide a friction grip, the advantage of the use of the disintegrating material is that there is no well residue when the disintegration is initiated because the entirety of the plug is from a disintegrating material. Contrary to the prevalent though of those skilled in the art, hardened materials that penetrate the surrounding tubular are not required particularly if the treatment is fracturing because some leakage is tolerable while the fracturing gets done. The number of ribs 38 may be increased for additional grip. The use of the disintegrating material also makes the expansion easier and requires less force with a reduced chance for cracking due to overexpansion.

Additionally, the configuration of the plug 24 is such that on setting the tab 26 is sheared off and removed with the mandrel 22 when the running tool that is not shown is actuated to set the plug 24 and removed from the borehole. As a result, the embodiment of the plug 24 that is made of a fully disintegrating material results in complete removal after the plug 24 has served its purpose as a barrier. Beyond that a piece of the body of the plug 24 in the form of tab 26 has already been sheared off. It should be noted that the top of the cone 34 has a formed seat for an object such as a ball for isolation. With the mandrel 22 removed during the expansion that sets the plug 24 the seat 45 is exposed to accept an object such as a ball that is not shown. The cone 34 defines a drift dimension through the plug in the set position.

Figure 2:
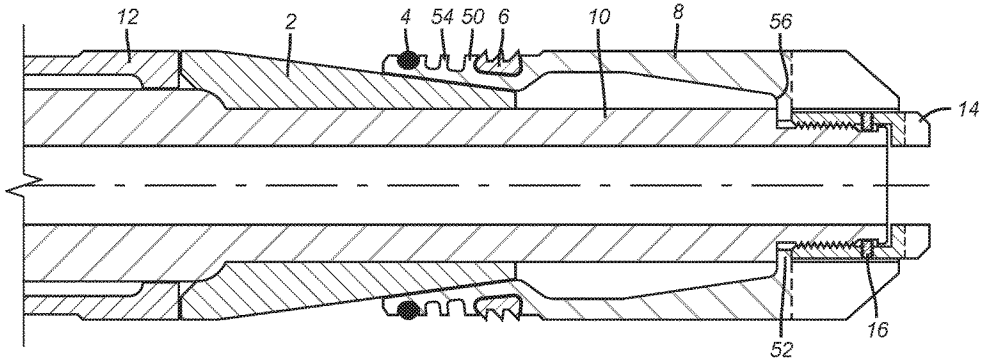
FIG. 2 is an alternative embodiment with o-ring(s) seal and hardened inserts that snap in with a c-ring shape or are pressed in with an interference fit from rib flexing.

FIG. 2 shows an alternative embodiment that differs from FIG. 1 in the sense that there is an o-ring 4 in an associated groove that is designed to engage the surrounding tubular that is not shown. Unlike the consensus in the past designs that provided a long rubber sleeve that was secured to the plug body, the present design dispenses with building up a wide rubber sleeve and putting ribs within the rubber or at opposed ends for an extrusion barrier. In the present design, it has been determined that one or more o-rings 4 in respective grooves on the plug body 8 will provide adequate sealing in applications such as fracturing where liquid tightness is not mandatory as long as there is enough pressure retention that allows the desired volume at the desired pressure to get into the formation to fracture the formation. While the o-ring(s) 8 do not disintegrate when the treatment with the plug body 8 is completed the other plug components can be made of a disintegrating material such as CEM so they can disintegrate when needed. In an option for the design with the o-ring 8 there can also be hardened inserts that can take the form of discrete segments or a split ring that can be snapped over the body 8. The segments form of the inserts 6 can be forced in an interference fit using elastic flexing of a nearby rib 50. On the other hand when using a c-ring shape for the insert 6 there is the availability of the potential energy in the snap ring that is initially flexed and then released into an associated groove. Such a groove can be formed with an adjacent rib such as 50 to get the combined effect of the potential energy in the ring and the interference fit from the flexing rib. While the hardened insert(s) 6 penetrate the surrounding tubular wall for enhanced grip they also do not disintegrate after use so that there is some residue from removal of the plug body 8 and the cone 2. As with the FIG. 1 embodiment, the setting process involves pushing with setting sleeve 12 and pulling the mandrel 10. As before when that happens the tab 52 is sheared off and taken out with the mandrel 10. While a single o-ring 4 and a single hardened insert 6 are shown multiple rows can also be used with the understanding that more material will not disintegrate at the end of the treatment procedure. The insert 6 can be carbide or polycrystalline diamond and it is designed to penetrate the surrounding tubular that is not shown for a grip. The points 54 of the ribs 50 do not penetrate the surrounding tubular and in this embodiment it is not even necessary that they even engage the surrounding tubular. This is because the anchoring is accomplished substantially by the insert(s) 6. As before the shoulder 56 can act as a travel stop but it is more likely that the cone 2 will stop well before reaching shoulder 56 as the inserts 6 penetrate the surrounding tubular. Tab 52 is retained by retaining nut 14 that is further held on with a set screw 16.

Those skilled in the art will appreciate that the illustrated plug designs can be used for treating operations at a subterranean location such as fracturing, injection, acidizing or conditioning the formation for production among other uses. In the FIG. 1 embodiment the plug is fully disintegrating after use as it is made from disintegrating materials that respond to well conditions created after use so that no residue remains for the subsequent operations or to injure other equipment that is in the vicinity. The plug can permit some leakage and still be useful for operations like fracturing even with a plurality of ribs that friction grab the surrounding tubular rather than penetrating the surrounding tubular. Additional anchoring can be obtained with adding more ribs but it has been determined that hardened inserts are not mandatory for functionality in fracturing service. An elongated rubber seal is also not needed if some leakage flow is tolerated. The advantage is the full disintegrating capability of a plug made from such materials in its entirety. On the other hand, FIG. 2 represents a design that leaves some but a minimal amount of residue while the balance of the plug disintegrates after use. It uses a spaced apart o-ring from a hardened insert. The use of one or more o-rings leaves less residue than larger rubber sleeves that had been used before to not only secure the inserts in position but to also give what was then thought to be the needed sealing area. As it turns out, one or more o-rings can give the needed or adequate sealing capability even if some leakage ensues from tubular out of roundness. The inserts are secured with an interference fit or a snap action independently of the o-rings. Rather than anchoring with a friction fit with rib tips as in the FIG. 1 embodiment, the FIG. 2 design uses the hardened inserts to penetrate the surrounding tubular so that the rib tips can either add the friction force for anchoring or simply not even contact the surrounding tubular. On the other hand when it comes time to disintegrate the plug there will be some residue to contend with since the carbide or diamond nature of the inserts will not disintegrate and neither will the rubber of the o-ring seals. However, at least 80% of the volume of the plug will disintegrate making the FIG. 2 design a more practical compromise design for some applications where very high pressure differentials are expected or where some leakage is also not tolerated as well. In both cases the cone has a seat for an object that is exposed when the plug is set and the setting mandrel comes out bringing with it the sheared tab from the plug body.

The above description is illustrative of the preferred embodiment and many modifications may be made by those skilled in the art without departing from the invention whose scope is to be determined from the literal and equivalent scope of the claims below:

We claim:

1. A treatment method at a subterranean location against a tubular wall, comprising:

applying differential pressure on a set plug made entirely of at least one disintegrating material comprising one or more of Mg, Mg-alloy, Al, Al-alloy, Mn, Mn-Alloy, Zn and Zn-alloy positioned at a predetermined subterranean location on a setting tool, said setting tool further comprising a setting tool mandrel for setting the plug;

positioning said setting tool mandrel in slidable contact with a cone for an anchoring feature;

setting the plug by relative movement of said setting tool mandrel with respect to said cone for radially expanding said anchoring feature by relative axial movement of said anchoring feature with respect to said cone when said setting tool mandrel is in contact with said cone;

removing said setting tool from the subterranean location;

performing the treatment operation with a differential pressure acting on said set plug;

disintegrating said plug.

2. The method of claim 1, comprising:

removing said setting tool from the subterranean location after said setting;

setting said plug with a wireline setting tool.

3. The method of claim 1, comprising:

using at least one circumferentially extending rib to engage the tubular for said setting.

4. The method of claim 3, comprising:

frictionally engaging said rib to the surrounding tubular during said setting.

5. The method of claim 3, comprising:

driving said cone into a tubularly shaped body of said plug for said setting.

6. The method of claim 5, comprising:

making said cone of a disintegrating material.

7. The method of claim 6, comprising:

setting said plug with said setting tool mandrel and setting sleeve on a wireline setting tool that are moved in opposed directions.

8. The method of claim 7, comprising:

shear releasing a tab from said plug for removal with said mandrel.

9. The method of claim 3, comprising:

using multiple ribs fabricated from a circular shape to reduce gaps among said ribs.

10. The method of claim 1, comprising:

driving said cone into a tubularly shaped body of said plug for said setting.

11. The method of claim 10, comprising:

making said cone of a disintegrating material.

12. The method of claim 10, comprising:

providing a travel stop on said plug for said cone.

13. The method of claim 10, comprising:

defining a drift dimension through said plug with a passage through said cone.

14. The method of claim 1, comprising:

setting said plug with said setting tool mandrel and setting sleeve on a wireline setting tool that are moved in opposed directions.

15. The method of claim 14, comprising:

shear releasing a tab from said plug for removal with said mandrel.

16. The method of claim 1, comprising:

providing said cone with a seat for an object;

exposing said seat for landing the object by removing said setting tool mandrel from a passage through said cone when accomplishing said setting.

17. The method of claim 16, comprising:

dropping the object on said seat;

building pressure on said object for said treating.

18. The method of claim 17, comprising:

tolerating some leakage while said pressure is built up on the object on said seat.

19. A treatment method at a subterranean location against a tubular wall, comprising:

applying differential pressure on a set plug made entirely of at least one disintegrating material comprising one or more of Mg, Mg-alloy, Al, Al-alloy, Mn, Mn-Alloy, Zn and Zn-alloy positioned at a predetermined subterranean location;

setting the plug by radially expanding an anchoring feature;

performing the treatment operation by said applying a differential pressure acting on said set plug;

disintegrating said plug;

setting said plug with a mandrel and setting sleeve on a wireline setting tool that are moved in opposed directions;

shear releasing a tab from said plug for removal with said mandrel;

retaining said mandrel to said plug using a shoulder on said mandrel and a retaining nut that is removed with said mandrel.

20. A treatment method at a subterranean location against a tubular wall, comprising:

applying differential pressure on a set plug made entirely of at least one disintegrating material comprising one or more of Mg, Mg-alloy, Al, Al-alloy, Mn, Mn-Alloy, Zn and Zn-alloy positioned at a predetermined subterranean location;

setting the plug by radially expanding an anchoring feature;

performing the treatment operation by said applying a differential pressure acting on said set plug;

disintegrating said plug;

using at least one circumferentially extending rib to engage the tubular for said setting;

driving a cone into a tubularly shaped body of said plug for said setting;

making said cone of a disintegrating material;

setting said plug with a mandrel and setting sleeve on a wireline setting tool that are moved in opposed directions;

shear releasing a tab from said plug for removal with said mandrel;

retaining said mandrel to said plug using a shoulder on said mandrel and a retaining nut that is removed with said mandrel.

21. The method of claim 20, comprising:

providing a seat on said cone for an object;

exposing said seat for landing the object by removing a said setting tool mandrel from a passage through said cone when accomplishing said setting.

22. The method of claim 21, comprising:

dropping the object on said seat;

building pressure on said object for said treating.

23. The method of claim 22, comprising:

tolerating some leakage while said pressure is built up on the object on said seat.

24. The method of claim 23, comprising:

frictionally engaging said rib to the surrounding tubular during said setting.

* * * * *